US005505405A

United States Patent [19]

Vigneau

[11] Patent Number: 5,505,405

[45] **Date of Patent: *Apr. 9, 1996**

[54] SURFACE REWINDER AND METHOD HAVING MINIMAL DRUM TO WEB SLIPPAGE

[75] Inventor: Richard J. Vigneau, Green Bay, Wis.

[73] Assignee: Paper Converting Machine Company, Green Bay, Wis.

[ * ] Notice: The term of this patent shall not extend beyond the expiration date of Pat. No. 5,370,335.

[21] Appl. No.: 280,436

[22] Filed: Jul. 28, 1994

Related U.S. Application Data

[63] Continuation-in-part of Ser. No. 19,074, Feb. 18, 1993, Pat. No. 5,370,335.

[51] Int. Cl.[6] ..... B65H 18/16

[52] U.S. Cl. ..... 242/542.1

[58] Field of Search ..... 242/542.1, 542.2, 242/542, 541.5, 541.6

[56] References Cited

U.S. PATENT DOCUMENTS

| | | | |
|---|---|---|---|
| 4,327,877 | 5/1982 | Perini | 242/542 |
| 4,909,452 | 3/1990 | Hertel et al. | 242/541.5 X |
| 5,031,850 | 7/1991 | Biagiotti | 242/542 |
| 5,104,055 | 4/1992 | Buxton | 242/542 |
| 5,368,252 | 11/1994 | Biagiotti | 242/542.1 X |
| 5,370,335 | 12/1994 | Vigneau | 242/542.1 |
| 5,402,960 | 4/1995 | Oliver et al. | 242/542.2 X |

FOREIGN PATENT DOCUMENTS

| | | |
|---|---|---|
| 498039 | 8/1992 | European Pat. Off. . |
| 2751829 | 5/1979 | Germany . |

*Primary Examiner*—John P. Darling
*Assistant Examiner*—Eileen A. Dunn
*Attorney, Agent, or Firm*—Tilton, Fallon, Lungmus & Chestnut

[57] ABSTRACT

A surface rewinder and method for cyclically and convolutely winding web logs wherein a three drum cradle includes spaced apart first and second winding drums and a rider drum and wherein the speed and/or space relationship of the drums is between the drums and a web being wound on a core as by moving one of the drums through a closed loop each cycle of winding.

21 Claims, 4 Drawing Sheets

FIG. 3A
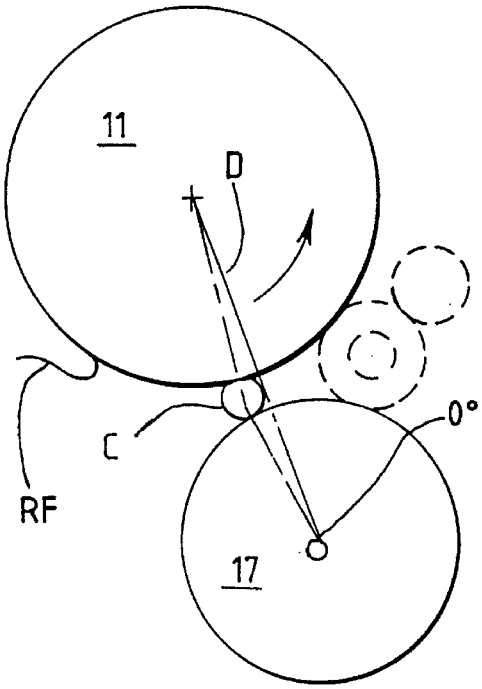
FIG. 3B
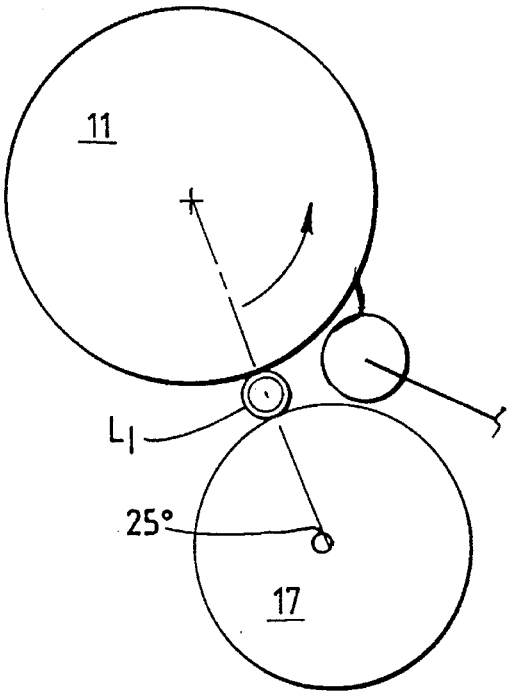
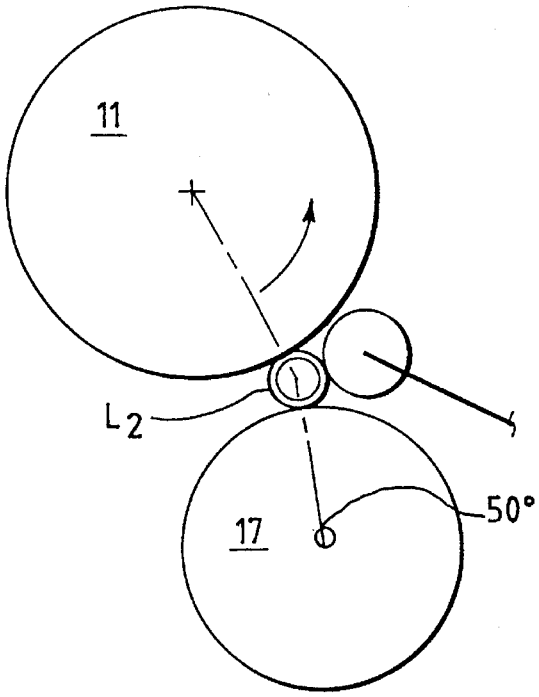
FIG. 3C
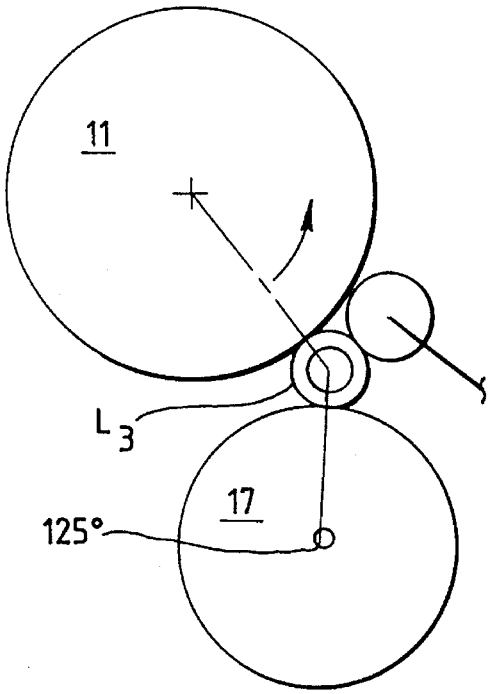
FIG. 3D

SURFACE REWINDER AND METHOD HAVING MINIMAL DRUM TO WEB SLIPPAGE

This application is a continuation-in-part of application Ser. No. 08/019,074 filed Feb. 18, 1993, now U.S. Pat. No. 5,370,335.

BACKGROUND AND SUMMARY OF INVENTION

This invention related to a surface rewinder and method and, more particularly, to a rewinder wherein the closed loop operation of one of the drums minimizes drum to web slippage.

In the past, two basic types of surface rewinders have been available commercially. One type of surface rewinder is seen in a co-owned U.S. Pat. No. 4,909,452 and features a movable winding drum. More particularly, the transition of the core and partially wound product from one side of the nip of the winding drums to the other is done with a combination of lower drum movement, infeed transfer finger exposure and speed differential between the two drums. At the beginning of the cycle the distance between the two winding drums is very quickly dropped. The infeed transfer fingers are then proportionately exposed and this, along with a small speed differential between the drums, quickly drives the product from one side of the drums' nip to the other. This allows the diameter of the product to build and move through the nip from one side to the other without additional compression. Thereafter, the speed differential remains constant.

Another surface rewinder can be seen in U.S. Pat. No. 4,327,877. This uses a speed change of one of the rolls also to quickly move the core and product partly wound thereon from one side of the pair of winding rolls to the other. This method compresses the product while the speed change advances the product. In operation, the lower drum speed quickly slows by controlled deceleration and then returns to the upper drum speed through the remainder of the wind cycle.

In each case, there is a degree of dependency on slippage between the product and the surfaces in contact therewith. If the drum surfaces are smooth enough to allow slippage, they also permit unstable products (typically soft rolls) which easily bounce around in the three drum winding area limiting the speed at which they can be run. Alternatively, smooth webs permit slippage but roughness results in bounces—see U.S. Pat. No. 1,719,830.

According to the invention in my earlier application noted above, the three drum cradle includes spaced apart first and second winding drums with control means operably associated with the drums for changing the rotational speed of one drum to substantially eliminate slippage. This was done by providing a speed profile wherein the speed of one of the winding drums was decreased in the beginning of each winding cycle to advance a partially wound roll through the space between winding drums and thereafter increasing the speed of the specific drum as a function of the increasing diameter of the partially wound roll.

The instant invention provides other ways of minimizing slippage in a surface winder. In one advantageous embodiment, this is achieved by moving one of the drums through an orbit or closed loop—and this is possible without varying the speed of either of the winding drums. However, the orbiting drum approach is also advantageous with a speed profile on one of the drums. The orbiting movement is advantageously applied to one of the winding drums and, alternatively or cumulatively, to the rider drum. And either or both drums can benefit from the previously-referred to speed profile.

Another embodiment employs the basic speed profile described in my earlier application but modifies the same to provide a selected portion in the completed log of a different tension, i.e., a portion at one radial position that can be either "harder" or "softer" than another portion. Certain converters and certain customers have different requirements which are thus easily met by modifying the speed profile determined by the winder controller. For example, a harder annulus near the core can prevent core collapse while a harder annulus adjacent the periphery aids in maintaining a constant diameter.

Other objects and advantages of the invention may be seen in the details of construction and operation set forth in the ensuing specification.

BRIEF DESCRIPTION OF THE DRAWING

The invention is described in conjunction with the accompanying drawing, in which

FIGS. 3A–G are sequence views, somewhat schematic of the relative positions of the lower winding drum and log being wound;

DETAILED DESCRIPTION

Figure 1:
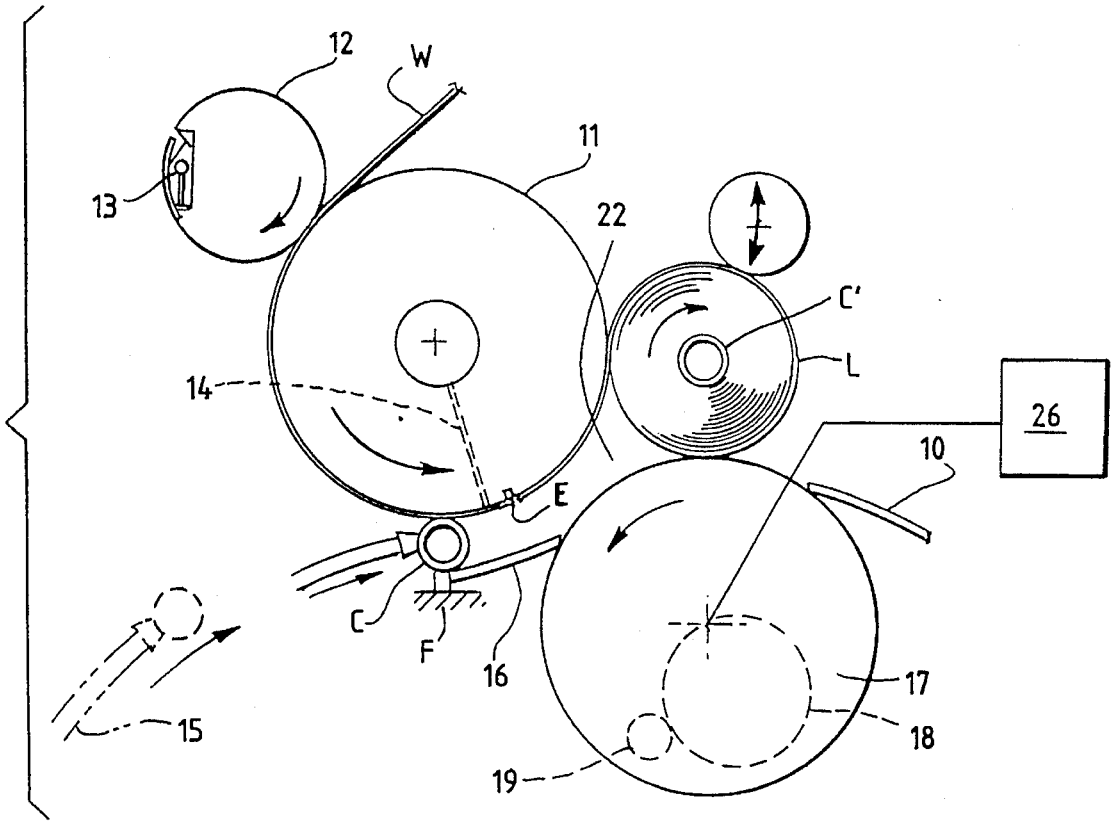
FIG. 1 is a schematic side elevational view of a surface rewinder incorporating teachings of my earlier application.

Referring first to FIG. 1, a typical three drum cradle is illustrated which is suitably mounted on a frame F—only part of which is illustrated in the lower central portion of FIG. 1. In conventional fashion, a pair of side frames (not shown in FIG. 1) are provided which support the various drums and other rotable members in rotatble fashion.

Starting at the upper left central portion of FIG. 1, the symbol W designates a web which is to be rewound from a parent roll (not shown in FIG. 1) into a log L—see the right central portion of FIG. 1. The log L has a diameter of the normally experienced bathroom tissue or kitchen toweling rolls and consists of a number of layers of convolutely wound web on a central core C'. The core in position C is shown in pre-wound condition and corresponds to the beginning of the winding cycle. At the end of the winding cycle, the log L is discharged along a ramp 10 for further processing—usually sawing the same transversely into retail size roll lengths.

Returning to the upper left portion of FIG. 1, the numeral 11 designates a first winding drum often referred to as a "bedroll" on which the web W is partially wrapped. Arranged on the frame F on the side of the web opposite to the first winding drum 11 is a knife drum 12 equipped with a knife 13 for coaction with the drum 11. The knife 13 operates to transversely sever the web at the end of one winding cycle and the beginning of another winding cycle. The web W thus has a leading edge E. A portion slightly reward of this is engaged by a vacuum port 14 (in this showing) to make sure that this leading edge portion of the now-severed web conforms to the periphery of the first winding drum 11 until transfer occurs to the glue equipped core C.

As shown in the lower left portion of FIG. 1 is the dotted line core being maintained on an inserting means 15 which moves in a generally arcuate path to the solid line position wherein the core is designated C. At this point, the core C encounters a stationary plate 16 which is analogous to that seen in co-owned U.S. Pat. No. 4,909,452. By virtue of the core C engaging both the rotating surface of the first winding drum 11 and the stationary surface of the plate 16, the core C is caused to rotate on the plate 16 and move to the right in FIG. 1. As the core C moves to the right its glue-equipped surface engages the web W adjacent the leading edge E thereof and begins the wind ultimately coming into contact with the lower or second winding drum 17. This second or lower winding drum 17 is mounted for movement away from the first winding drum 11 in a closed loop shown in dotted line as at 18. Drive means such as a pulley 19 can be employed to move with the drum 17 while providing rotation therefor.

In the operation of the invention in my earlier application, the web W is unwound from a source such as a jumbo parent roll and proceeds as illustrated on the surface of the rotating first drum 11, being transversely severed by the knife 13 on the knife drum 12. Thereafter, the leading edge of the now-severed web encounters the core C and is wound thereon first as the core C travels to the right on stationary plate 16 and thereafter on the surface of the winding drum 17.

Figure 2:
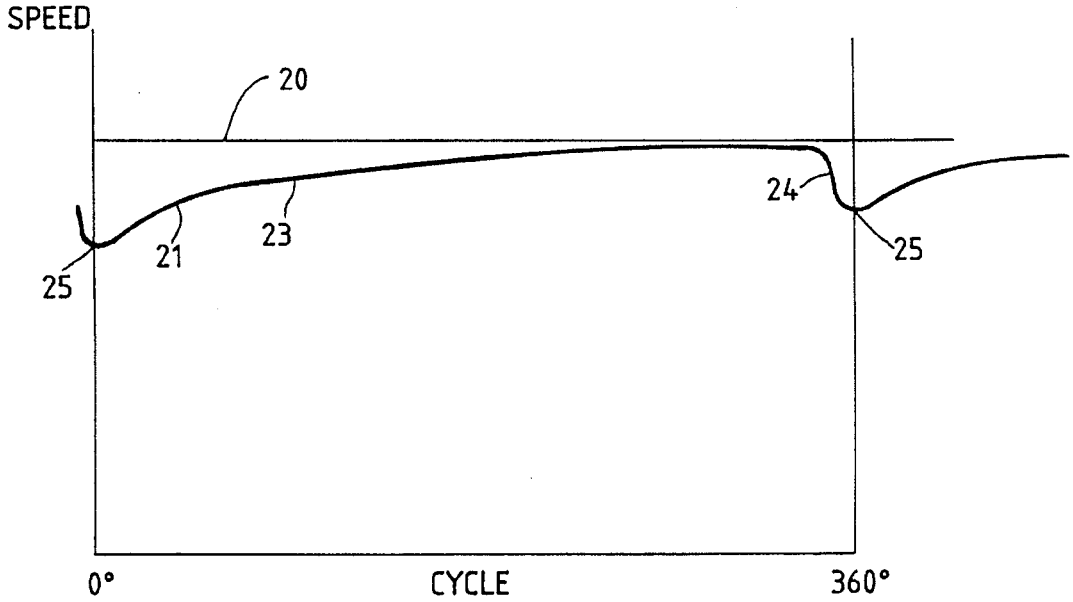
FIG. 2 is a graph of the speed profile developed in one of the winding rolls according to the teachings of my earlier application.

At the beginning of the winding cycle which is designated 0° at the left end of the abscissa entitled CYCLE in FIG. 2, the speed of the second winding drum 17 is relatively slow in comparison with the constant speed 20 of the first winding drum 11. This lower drum speed 21 increases fairly rapidly over the initial part of the wind so as to propel the now partially wound roll through the space or nip 22 between the first and second winding drums 11, 17. Thereafter, the speed of the second winding drum follows a path designated 23 which approaches but does not precisely equal the surface speed of the first winding drum and which increases as a function of the increasing diameter of the partially wound roll. Then, at the end of the cycle or close thereto, the speed of the second winding drum (the lower drum shown herein) drops as rapidly as possible as at 24 so as to be ready to start another winding cycle as at 25 (see both ends of the plot of FIG. 2). A controller 26 is advantageously associated with the overall winder and in particular with the various mechanisms operated to rotate, move etc the lower winding roll 17.

Inasmuch as slippage can be substantially eliminated, it is possible to equip the other surfaces of one or both of the winding drums 11, 17 with non-slip material without damaging the web W.

EMBODIMENT OF FIGS. 3A–3G, 4 and 5

Referring to FIGS. 3A–G, the numeral 11 once again designates the upper winding drum while the numeral 17 designates the lower winding drum. This particular sequence of views demonstrates how the orbiting or closed path loop of movement of the lower winding drum can be used to achieve substantial elimination of slippage between the web being wound and the lower winding drum but without employing a speed profile of the nature previously described in conjunction with FIG. 2. In fact, the speed profile of the lower drum is a constant as can be appreciated from FIG. 4 where this is designated 20' in contrast to the speed profile of the upper drum which is designated 20. In other words, there is no variation of the speed of the lower winding drum 17 throughout a given cycle. The effect of this in combination with the orbiting of the lower winding roll 17 as illustrated in FIGS. 3A–G is to provide a result equivalent to that developed by speed profiling the lower winding roll.

For example, at the beginning of the cycle, which is designated 0° in FIG. 3A, it is seen that the core C is behind the dash-dot line D connecting the centers of the upper and lower winding drums. Also, the leading edge portion of the web may be folded back on itself in a reverse fold RF.

Figure 3E:
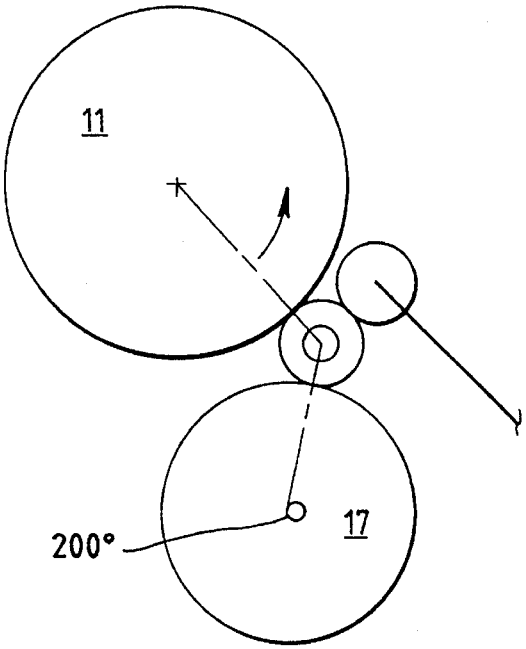

As one progresses through the positions, it will be noted that the core C and, subsequently the newly wound log, is moving slowly to the right while the lower winding drum 17 is orbiting rapidly clockwise in a generally elliptical orbit. This can be appreciated from the FIG. 3A–G sequence. In FIG. 3B there has been a relatively small movement to the right of the log $L_1$ while the lower winding roll 17 has moved through 25° of the winding cycle.

Figure 3F:
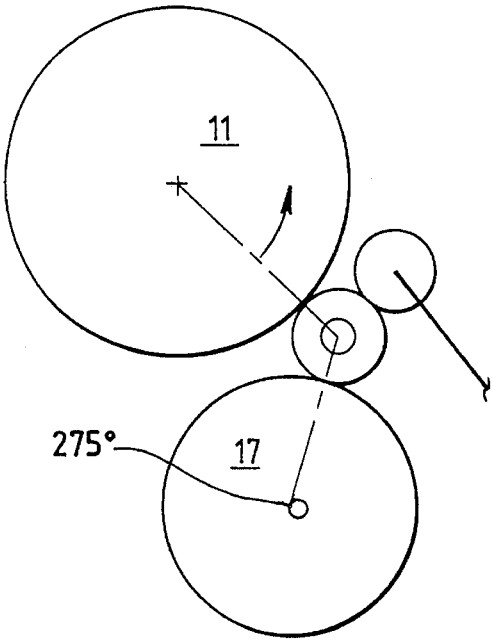
Figure 3G:
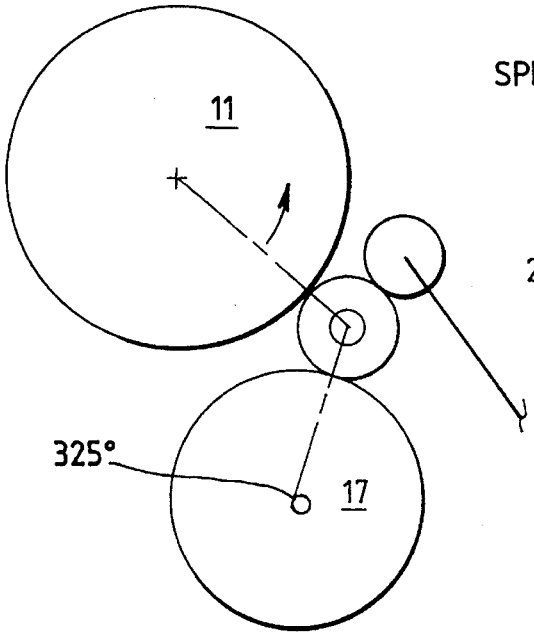
Figure 4:
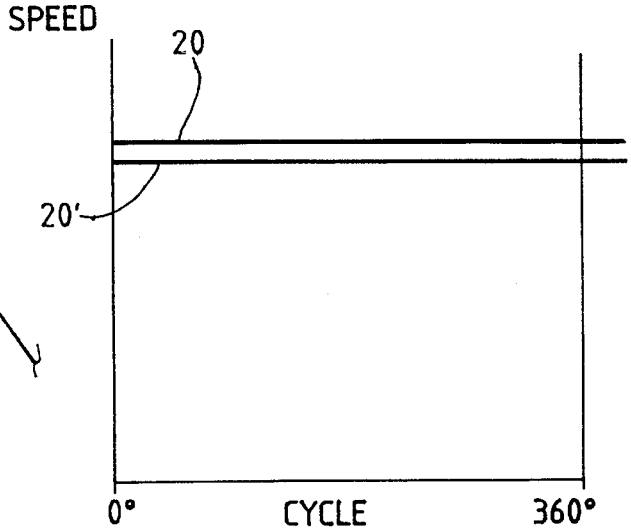
FIG. 4 is a chart of speed versus cycle position to illustrate the relative speeds of the upper and lower winding drums in the embodiment depicted in FIGS. 3A–G.

Then in FIG. 3C, there is again a relatively small movement of the log to the position $L_2$ while the lower winding roll 17 has moved through a total of 50° of the winding cycle, nearly half way around the orbit. In FIG. 3D, the log $L_3$ has moved again slowly toward the right whereas the drum 17 has moved through 125° of the winding cycle. In similar fashion the log is seen to progress more rapidly to the right as the winding roll 17 proceeds through the remainder of its orbit —FIGS. 3E–G showing drum positions of 200°, 275° and 325°, respectively of the winding cycle Thus, this profiled movement of the lower drum provides an opportunity to use a linear speed differential between the upper and lower winding drums 11, 17, respectively as shown in FIG. 4 at 20, 20', respectively.

ILLUSTRATION IN FIG. 5

Figure 5:
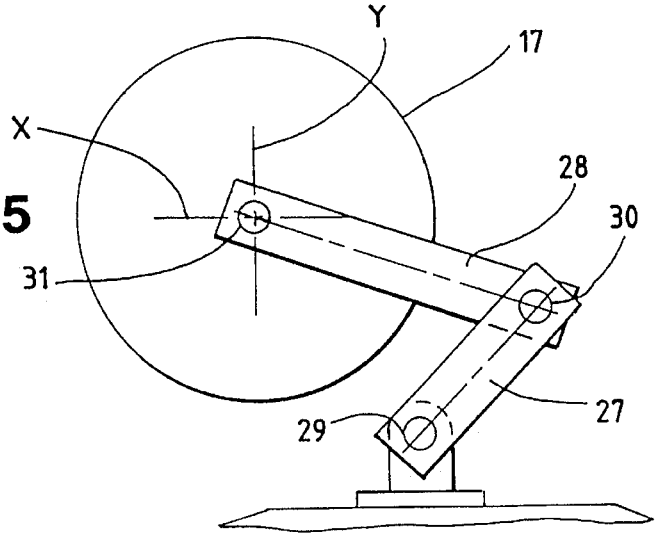
FIG. 5 is a side elevation, essentially schematic of a linkage useful in developing the closed loop or orbiting motion of the lower winding drum.

The means for achieving this advantageous operation so as to develop an advantageous alternative to the speed profile or an advantageous addition to the speed profile, i.e., the speed profile and the orbiting lower winding roll in combination, is illustrated schematically in FIG. 5. Now referring to FIG. 5, the lower winding drum is again designated 17 and is mounted for movement relative to both a horizontal axis X and a vertical axis Y, moving through the orbit 18— see FIG. 1. A variety of linkages can be employed for doing this, one simple linkage being a two bar linkage including arms 27, 28 on each side frame. Each arm 27 is pivoted on the frame F at 29 and pivotally interconnected with the arm 28 at 30. The other end of the arm 28 is pivotally interconnected with the bearings 31 supporting the journals of the drum 17. Actuators such as fluid pressure cylinders may be employed for moving the arms 27, 28 and thus the bearings 31. The operation of the fluid pressure cylinders (not shown) is advantageously achieved through the use of a controller 26 as was previously pointed out relative to FIG. 1.

EMBODIMENT OF FIG. 6

Figure 6:
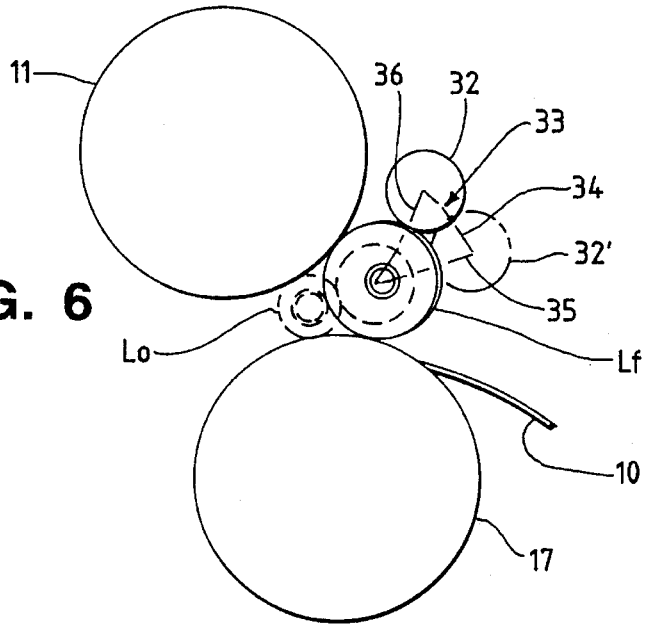
FIG. 6 is a side elevational view, essentially schematic, of an embodiment of an invention showing an orbiting rider drum.

Referring to FIG. 6, the usual three drum cradle is illustrated again with the upper and lower winding drums being designated 11 and 17, respectively. The rider roll (which has been previously shown in FIG. 1 but not designated) is here designated by the numeral 32 and is seen to be in a variety of positions. The solid line position designated 32 is the position the rider drum occupies at the end of the winding cycle and just prior to the time the log $L_f$ starts its descent along the inclined plane or ramp 10.

The rider drum 32 is supported on a linkage mechanism operative to provide 2 degrees of freedom or movement as along both X and Y axes much the same as was illustrated in FIG. 5 relative to the orbiting or elliptical movement of the lower winding drum 17. Here the orbit of the rider drum 32 center is more in the nature of a spherical triangle shown in dotted line and generally designated 33. One leg of the triangle designated 34 is seen to be somewhat arcuate stemming from the fact that the rider drum follows the contour of the log $L_f$. Thus, the leg 34 is convex, i.e., outwardly arcuate relative to the interior of triangle 33.

The second leg 35 is shown as a straight line based on the fact that the drums 11, 17 are of identical diameters. When this is the case, the center of the log moves in a straight line to the position 32'. However, in most cases, the diameters are different—with the lower winding drum having the smaller diameter. In such a case, the log follows the lower drum and the log center therefore moves along an arcuate path. So also does the rider drum to press against the log along a line passing through the center. Therefore, the rider drum 32 (and its center) moves along an arcuate path which is inwardly concave—relative to the interior of the triangle.

The third side 36 of the generally spherical triangle 33 is also arcuate, i.e., inwardly concave, and represents a fairly rapid movement following the contour of the upper winding drum 11 and the exterior contour of the final log $L_f$—reaching into tangency with the beginning log $L_0$.

Figure 7:
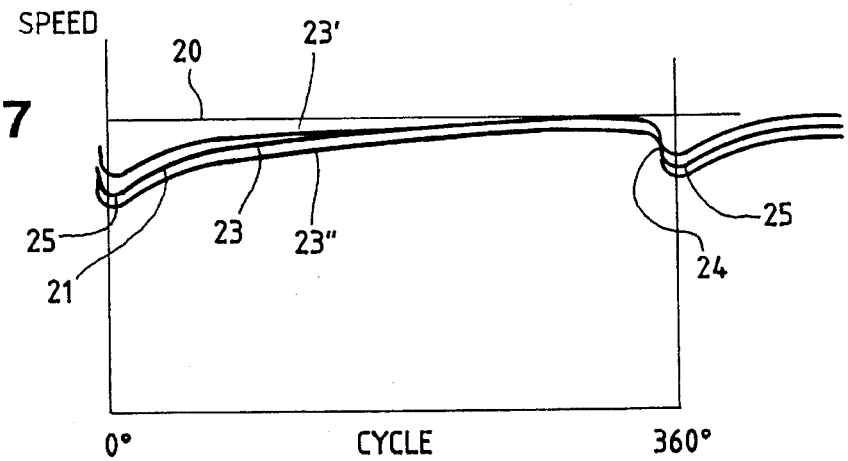
FIG. 7 is a chart showing speed as a function of cycled degrees for taper winding, i.e., is a predetermined tension differential in one portion from another portion.

The advantage of this system illustrated in FIG. 7 is the ability to contain the product within an approximately equilateral triangle between the upper and lower drums and the rider drum. Even though this has been the goal of previous three-drum cradles, typically done with a single pivoting or arcuate movement, it has been achieved imperfectly because the single arcuate path departs substantially from the generally equilateral triangle made possible by practice of the invention of the embodiment of FIG. 7. For example, during the segment designated 35, the invention provides the best containment angle for stability of wind. At the end of the segment 35 and during the segment 34 it is advantageous to provide for discharge of the product by having the rider roll move out of a containment position relative to the almost completed log. Thereafter, the return is expeditious because of the unique geometry provided by this embodiment of the invention. Thus, this embodiment features a rider drum that has its center moving through a spherical triangle with generally arcuate sides. It is also advantageous to provide a speed profile—generally of the FIG. 2 nature—to the rider drum.

EMBODIMENT OF FIG. 7

Referring to FIG. 7, it will again be noted that the numeral 20 designates the flat speed profile of the upper winding drum 11. The numeral 21 designates the speed profile of the lower winding drum 17 and corresponds to that seen in FIG. 2. For example, the lower drum speed 21 increases fairly rapidly over the initial part of the wind so as to propel the now partially wound roll through the space 22 (FIG. 1). Thereafter, the speed of the second winding drum follows a path designated 23 which approaches but does not precisely equal the surface speed of the first winding drum and which increases as a function of the increasing diameter of the partially wound roll. Then at the end of the cycle or close thereto, the speed of the second winding drum (the lower winding drum shown herein) drops as rapidly as possible as at 24 so as to be ready to start another winding cycle as at 25.

The upper curve 23' of the group of three lower curves illustrates a taper wind which is tighter or of higher tension at the start of the wind. Conversely, the lowest curve 23' is of a taper wind that is looser at the start and relatively tighter at the end. The showing in FIG. 7 is merely illustrative of two variations from the previously described speed profile based upon a function of the increasing diameter of the log being wound. By suitable variation of the speed signal coming from the controller 26, it is possible to localize the different "taper" in any position of the cycle as desired and the taper may be either "softer" or "harder" than the remainder or even of only an adjacent annulus of the completed log.

When the surface speed of the lower drum 17 follows the upper curve 23', the speed differential between the upper and lower drums 11, 17 is less than when following the curve 23. This results in lesser or slower movement of the incipient log $L_0$ from the nip or space 22 between drums 11, 17 and thus a tighter wind. A tighter wind near the core C may be advantageous in the instances where there is a tendency of the core to collapse during log sawing. Where there is a tighter portion at the beginning of the wind, there is required a looser portion later in the wind—if a prescribed roll diameter is to be achieved.

When the speed profile is that of 23", there is a greater speed differential between the drums 11, 17 which results in moving the incipient log $L_0$ faster through the nip and into the three-drum cradle under such circumstances, a looser wind results in the beginning portion of the log $L_0$, i.e., the portion adjacent the core. This can be advantageous when the log has a tendency to "telescope" i.e., convolutions extending axially outward of each other—as in the case of an extended "telescope". Again, there has to be a compensatory portion if a prescribed diameter is to be met—here the outer portion must be tighter.

The factors influencing the selection of a taper wind include basically the geometry of the system and the character of the web being wound.

SUMMARY

The invention relates to a surface rewinder for continuously winding convolutely wound web rolls comprising a frame F, a three drum cradle rotatably mounted on the frame and including spaced apart first and second winding drums 11, 17 and a rider drum 32. Also provided on the frame are means for rotating each drum such as the pulley 19 illustrated in FIG. 1 relative to the second or lower winding drum 17. A similar type drive may be employed for the first or upper winding drum to drive it at web speed. Similarly, a drive can be provided for the rider drum 32 although in some instances this drum may be an idler in which case the means for rotating the rider drum may be similar to the bearings 31 of FIG. 5. The invention further includes core introducing means 15 for moving a core C toward the space between the first and second winding drums, means such as cooperating drums 11, 12 for continuously introducing a web into contact with a core being moved toward the space 22 between drums 11, 17 for cyclically winding said web on cores sequentially, and means to substantially eliminate slippage between a web being wound on the core and the second drum (and also to compensate for core movement). This is the means as at 27–31 for orbiting the lower winding drum 17 or the rider drum 32 or both. The rider drum orbit is seen at 33 in FIG. 6. Suitable orbiting means include the arms 27, 28 of FIG. 5.

As disclosed in my earlier application, the lower drum 17 may have a speed profile applied thereto as seen in FIG. 2 but such a profile may also be applied advantageously to the rider drum 32. The speed profile of the rider drum 32 differs from that of the lower winding drum 17 because, at the end of the cycle, it has to run faster to insure removal of the roll product, i.e., the log L. Thereafter, the rider drum 32 has a differently positioned profile because it is at a different distance from the upper drum 11. The slope or rate of increase of the speed profile therefore depends on the geometry of the system.

In the illustration given, after log discharge, the rider drum speed is decreased to web speed and, thereafter, increased as a function of the increasing diameter of the log being wound.

When such a speed profile is employed, it is also advantageous to deviate therefrom slightly as depicted in FIG. 7 at 23' and 23". This can result in annular portions of the convolutely wound log that are different (tighter/looser or harder/softer) than an adjacent annulus. This tapered tension wind can also be imposed on the rider drum to advantage.

Further aspects of the invention include equipping the frame with means for moving each of the lower or second winding drum 17 and the rider drum 32 through an orbit each cycle of the winding. The invention also includes providing a speed profile for the rider drum wherein the speed thereof after contact with the web being wound is a function of the increasing diameter of a partially wound core. Still further, the invention includes control in the rotational speed of the winder drum to substantially eliminate slippage between the rider drum and a web log being wound on a core and also provide a speed profile in the rider drum wherein the speed of the rider drum is increased just prior to the beginning of each winding cycle to discharge the finished wound log, the speed then being decreased about the time the second or lower winding drum 17 has advanced a partially wound log through the space between the first and second winding drums and then the speed is then increased as a function of the increasing diameter of the partially wound log. Even further, the invention includes the control means as at 26 providing for deviating from the speed profile of the rider roll 32 to provide a taper tension wind wherein one portion of the log is of a tension different from another portion adjacent hereto.

While in the foregoing specification, a detailed description of the invention has been set down for the purpose of illustration, many variations in the details herein given may be made without departing from the spirit and scope of the invention.

I claim:

1. A surface rewinder for continuously winding convolutely wound web logs comprising a frame, a three drum cradle mounted on said frame and including spaced apart first and second winding drums and a rider drum, means on said frame for rotatably mounting each of said drums, core introducing means on said frame for moving a core toward the space between said first and second winding drums, means for continuously introducing a web into contact with the core being moved toward said space for cyclically winding the web on the cores sequentially to form logs, and means to substantially eliminate slippage between a web being wound on said core and one of said drums, and to compensate for core movement including means for moving said one drum through a closed loop during each cycle of winding.

2. The rewinder of claim 1 in which said one drum is said second winding drum.

3. The rewinder of claim 1 in which said one drum is said rider drum.

4. The rewinder of claim 1 in which said frame is equipped with means for moving each of said second winding drum and said rider drum through an orbit each cycle of winding.

5. The rewinder of claim 4 in which control means are associated with said frame for providing a speed profile in both said second winding drum and rider drum wherein the speed of said second winding drum is decreased just prior to the beginning of each winding cycle to advance a partially wound log toward and through said space and the speed thereafter increased as a function of the increasing diameter of a log being wound on said core while said rider drum speed is increased just prior to the beginning of each winding cycle to discharge the finished wound log, the speed then being decreased and thereafter increased as a function of the increasing diameter of a log being wound on said core.

6. The rewinder of claim 1 in which said one drum is said rider drum, means operably associated with said frame for rotating said rider drum, and control means for changing the speed of said rider drum to substantially eliminate slippage between said rider drum and the web being wound to provide a speed profile wherein the speed of said rider drum after contact with said web being wound is a function of the increasing diameter of a partially wound core.

7. The rewinder of claim 6 in which said control means also provides for deviating from said speed profile to provide a taper tension wind wherein one portion of said log is of a tension different from another portion adjacent thereto.

8. The rewinder of claim 1 in which said one drum is said second winding drum, control means operably associated with said frame for changing the rotational speed of said second winding drum to substantially eliminate slippage between said second winding drum and the web being wound on said core and also provide a speed profile in said second winding drum wherein the speed of said second winding drum is decreased just prior to the beginning of each winding cycle to advance a partially wound log toward and through said space and thereafter increasing the speed of said second winding drum as a function of the increasing diameter of said partially wound log, said control means also providing for deviating from said speed profile to provide a tapered tension wind wherein one portion of said log is of a tension different from that of another portion.

9. The rewinder of claim 8 wherein said one portion is of a tighter tension than said another portion, said one portion being adjacent said core.

10. The rewinder of claim 8 in which said one portion is of higher tension than that of said another portion, said one portion being adjacent the periphery of said log.

11. A surface rewinder for continuously winding convolutely wound web rolls comprising a frame, a three drum cradle rotatably mounted on said frame and including spaced apart first and second winding drums and a rider drum, means on said frame for rotating each of said drums, core introducing means on said frame for moving a core toward the space between said first and second winding drums, means for continuously introducing a web into contact with the core being moved toward said space for cyclically winding said web on cores sequentially, and means on said frame mounting said rider drum for movement through a closed loop during each winding cycle.

12. The rewinder of claim 11 in which said means for mounting said rider roll provides said closed loop in the nature generally of a spherical triangle.

13. A method for continuous winding convolutely wound web logs comprising the steps of providing a frame, a three drum cradle rotatably mounted on said frame and including spaced apart first and second winding drums and a rider drum, means on said frame for rotating each of said drums, providing a web and cores for winding in said frame and providing core introducing means on said frame for advancing cores sequentially toward the space between said first and second winding drums, continuously introducing a web into contact with cores being advanced toward and through said space for cyclically winding said web on cores sequentially, and by compensating for the advancement of said cores to minimize slippage between said second winding drum and said web by moving one of said drums through a closed loop each cycle of winding.

14. The method of claim 13 in which said compensating step includes moving said second winding drum through a closed loop each cycle of winding.

15. The method of claim 13 in which said compensating step includes moving said rider drum through a closed loop each cycle of winding.

16. The method of claim 13 in which said compensating step includes for each cycle, in addition to first decreasing the speed of said second winding drum and thereafter increasing said speed as a function of the increasing diameter of a partially wound log, modifying said increasing speed to provide a portion of the completely wound log with a tension different from another portion of said completely wound log.

17. A method for cyclically and convolutely winding a web log comprising the steps of providing a frame, a three drum cradle rotatably mounted on said frame including spaced apart first and second winding drums and a rider drum, means on said frame for the rotating of each of said drums, core introducing means on said frame for moving a core toward the space between said first and second winding drums, moving said second drum to change the space between said first and second winding drums, and thereafter moving said second winding drum in a closed loop path each cycle of winding.

18. A method for convolutely winding web logs comprising providing a three drum cradle rotatably mounted on a frame and including spaced apart first and second winding drums and rider drum, providing means for the rotation each of said drums, moving a core toward the space between said first and second winding drums, controlling the rotational speed of said second winding drum to substantially eliminate slippage between said second winding drum and a web log being wound on said core and also provide a speed profile in said second winding drum wherein the speed of said second drum is decreased just prior to the beginning of each winding cycle to advance a partially wound log through said space and thereafter the speed is increased as a function of the increasing diameter of said partially wound log, and modifying said increasing speed to provide an annular portion of a wound log with a hardness/softness different from another portion of said wound log.

19. A method for convolutely winding web logs comprising providing a three drum cradle rotatably mounted on a frame and including spaced apart first and second winding drums and a rider drum, rotating each of said drums, moving a core toward the space between said first and second winding drums, and controlling the rotational speed of said rider drum to substantially eliminate slippage between said rider drum and a web log being wound on said core and also provide a speed profile in said rider drum wherein the speed of said rider drum is increased just prior to the beginning of each winding cycle to discharge the finished wound log, the speed is then decreased about the time said second winding drum has advanced a partially wound log through said space, the speed is then increased as a function of the increasing diameter of said partially wound log.

20. A method for cyclically and convolutely winding web logs comprising providing a three drum cradle rotatably mounted on a frame and including spaced apart first and second winding drums and a rider drum, rotating each of said drums, moving a core toward the space between said first and second winding drums, and moving said rider drum through a closed loop each cycle of winding.

21. The method of claim 20 in which said loop is generally a spherical triangle.

* * * * *